US008918004B2

(12) United States Patent
Egusa et al.

(10) Patent No.: US 8,918,004 B2
(45) Date of Patent: Dec. 23, 2014

(54) FIXING APPARATUS WITH CONTROLLER FOR CONTROLLING AMOUNT OF POWER TO HEATER

(71) Applicant: Fuji Xerox Co., Ltd., Tokyo (JP)

(72) Inventors: Naoyuki Egusa, Kanagawa (JP); Makoto Furuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/857,327

(22) Filed: Apr. 5, 2013

(65) Prior Publication Data

US 2014/0099136 A1 Apr. 10, 2014

(30) Foreign Application Priority Data

Oct. 5, 2012 (JP) ..... 2012-223170

(51) Int. Cl.
*G03G 15/20* (2006.01)

(52) U.S. Cl.
USPC ..... 399/69; 399/334

(58) Field of Classification Search
CPC G03G 15/20; G03G 15/2003; G03G 15/2007
USPC ..... 399/334, 336, 69; 219/216
See application file for complete search history.

(56) References Cited

U.S. PATENT DOCUMENTS

2013/0071160 A1 * 3/2013 Matsubara et al. ..... 399/336

FOREIGN PATENT DOCUMENTS

| | | | | |
|---|---|---|---|---|
| JP | 60107068 | A | * | 6/1985 |
| JP | A-61-219977 | | | 9/1986 |
| JP | A-5-134578 | | | 5/1993 |
| JP | A-6-118821 | | | 4/1994 |
| JP | A-2006-091543 | | | 4/2006 |
| JP | 2007087713 | A | * | 4/2007 |
| JP | 2010164787 | A | * | 7/2010 |

OTHER PUBLICATIONS

Office Action issued in Japanese Application No. 2012-223170 dated Feb. 25, 2014 (with translation).

* cited by examiner

*Primary Examiner* — Robert Beatty
(74) *Attorney, Agent, or Firm* — Oliff PLC

(57) ABSTRACT

A fixing device includes a fixing unit that is disposed in a direction intersecting a transport direction in which a recording medium on which an image is formed using an image forming material is transported and that fixes the image forming material onto the recording medium in a noncontact manner with the recording medium, a varying unit that varies a length of the fixing unit in a direction perpendicular to the transport direction, and a controller that controls the fixing unit at an amount of power according to the length of the fixing unit.

7 Claims, 7 Drawing Sheets

FIXING APPARATUS WITH CONTROLLER FOR CONTROLLING AMOUNT OF POWER TO HEATER

CROSS-REFERENCE TO RELATED APPLICATIONS

This application is based on and claims priority under 35 USC 119 from Japanese Patent Application No. 2012-223170 filed Oct. 5, 2012.

BACKGROUND

Technical Field

The present invention relates to a fixing device, and an image forming apparatus.

SUMMARY

According to an aspect of the present invention, there is provided a fixing device including a fixing unit that is disposed in a direction intersecting a transport direction in which a recording medium on which an image is formed using an image forming material is transported and that fixes the image forming material onto the recording medium in a noncontact manner with the recording medium; a varying unit that varies a length of the fixing unit in a direction perpendicular to the transport direction; and a controller that controls the fixing unit at an amount of power according to the length of the fixing unit.

BRIEF DESCRIPTION OF THE DRAWINGS

Exemplary embodiments of the present invention will be described in detail based on the following figures, wherein.

DETAILED DESCRIPTION

Figure 1:
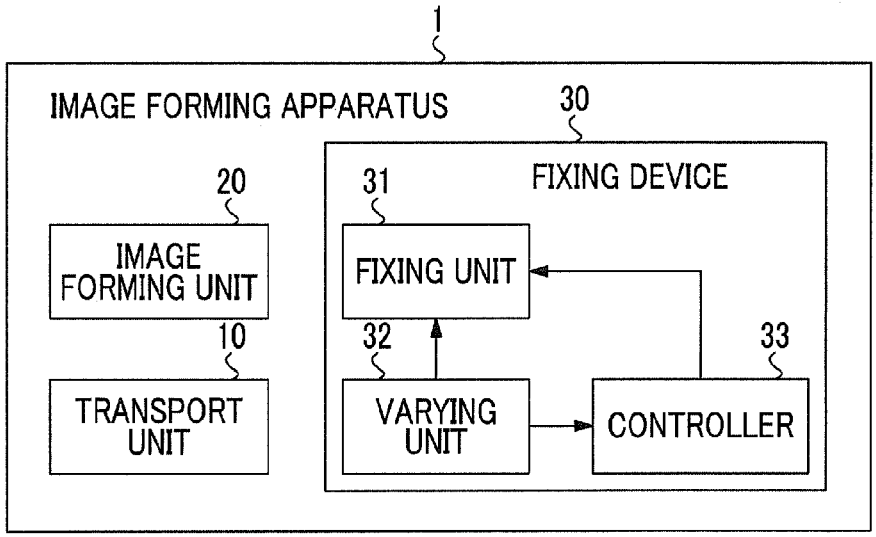
FIG. 1 is a diagram illustrating a configuration of an image forming apparatus according to an exemplary embodiment.

FIG. 1 is a diagram illustrating a configuration of an image forming apparatus 1 according to an exemplary embodiment. The image forming apparatus 1 is an apparatus which forms an image on a recording medium in a predetermined method (for example, an electrophotographic method), for example, a printer. The recording medium is a sheet-shaped medium in which an image is formed on a surface thereof, for example, paper. In this example, as the recording medium, so-called continuous paper (also referred to as a continuous form or continuous forms paper) is used. The image forming apparatus 1 includes a transport unit 10, an image forming unit 20, and a fixing device 30. The transport unit 10 transports a recording medium from the image forming unit 20 to the fixing device 30. The transport unit 10 includes, for example, rollers, belts, and driving circuits thereof. The image forming unit 20 forms an image on the recording medium using an image forming material (for example, toner). The image forming unit 20 includes, for example, a photoconductor drum, a charging device, an exposure device, a developing device, and a transfer device. The fixing device 30 fixes the image forming material onto the recording medium.

The fixing device 30 includes a fixing unit 31, a varying unit 32, and a controller 33. The fixing unit 31 is disposed in a direction intersecting a transport direction in which the recording medium is transported. The fixing unit 31 fixes an image forming material onto a recording medium in a non-contact manner with the recording medium. In this example, the fixing unit 31 has plural fixing elements. The varying unit 32 varies a length of the fixing unit 31 in a direction perpendicular to the transport direction. The controller 33 controls the fixing unit 31 with an amount of power corresponding to the length of the fixing unit 31. In this example, an amount of power supplied under the control of the controller 33 is an amount of power for operating the overall fixing unit 31, that is, an amount of power for operating all the plural fixing elements. In addition, in this case, it is not necessary for the same amount of power to be supplied to all the fixing elements.

Figure 2A:
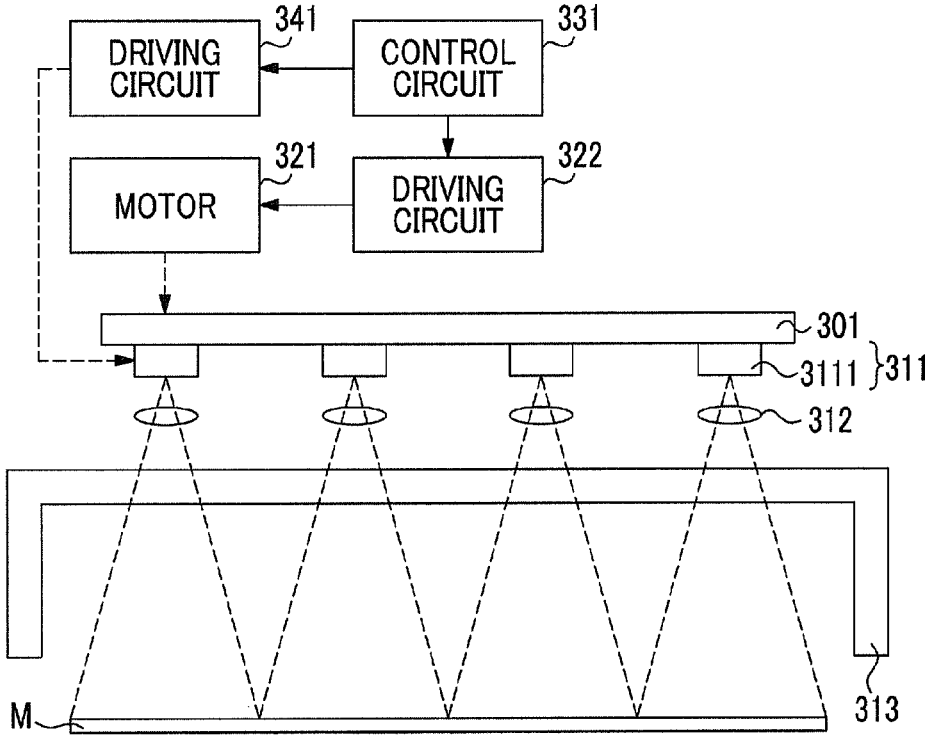
FIGS. 2A and 2B are schematic diagrams exemplifying a detailed configuration of a fixing device.
Figure 2B:
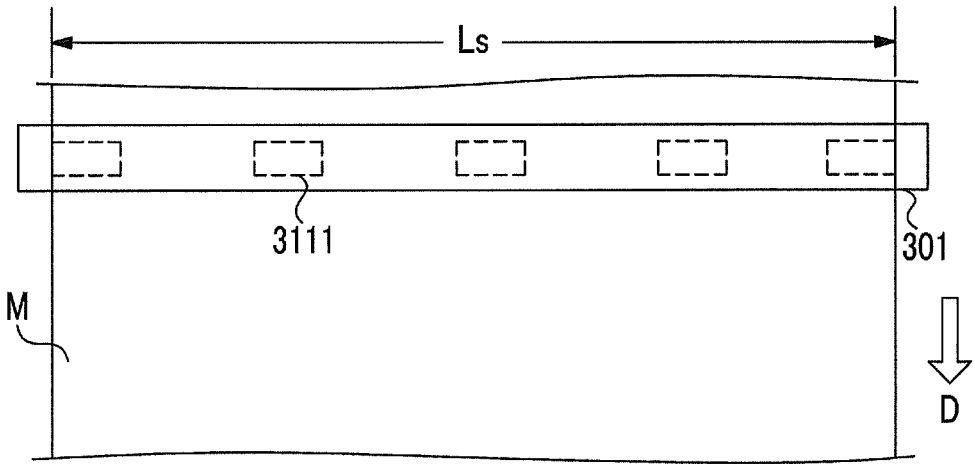

FIGS. 2A and 2B are schematic diagrams exemplifying a detailed configuration of the fixing device 30. Here, a description will be made of an example of fixing an image forming material onto a recording medium M using light energy. FIG. 2A is a cross-sectional schematic view of the fixing device 30 when viewed from the downstream side of a transport direction D of the recording medium M, and FIG. 2B is a schematic diagram of the fixing device 30 when viewed from a direction perpendicular to the recording medium M. In this example, the fixing device 30 includes a supporting member 301, an irradiation unit 311, an optical member 312, a reflector 313, a motor 321, a driving circuit 322, a control circuit 331, and a driving circuit 341. The supporting member 301 is a member supporting the irradiation unit 311, the optical member 312, and the reflector 313. In addition, in FIG. 2B, for simplicity, only some elements are shown.

The irradiation unit 311 is a device which applies light for fixing an image forming material onto the recording medium M, and is a laser array in this example. In other words, the irradiation unit 311 includes n light emitting elements 3111. The light emitting elements 3111 are, for example, laser diodes. In relation to the laser diodes, a single laser diode may be cut singly individually, and plural laser diodes may be integrated into one chip. In this example, the n light emitting elements 3111 are disposed in one direction with a constant interval. Now, a length from the light emitting element 3111 of one end to the light emitting element 3111 of the other end is set to a length Ls of the irradiation unit 311. The driving circuit 341 is a device driving the irradiation unit 311 (laser array). The optical member 312 is a member which controls a light path of light applied from the irradiation unit 311, and includes, for example, n lenses. The reflector 313 is a device which further reflects light which is applied from the irradiation unit 311 and is reflected by the recording medium M, and applies the light to the recording medium M again. The reflector 313 has a reflective surface facing the recording medium M. The reflective surface includes, for example, mirror-polished metal (for example, aluminum). The irradiation unit 311, the optical member 312, and the reflector 313 are fixed to the supporting member 301.

The motor 321 rotates the supporting member 301 (that is, rotates the laser array) with respect to a predetermined rotation axis intersection a transport surface of the recording medium M in a surface parallel to the recording medium M.

The driving circuit 322 is a device which controls driving of the motor 321. The image forming apparatus 1 can form an image on the recording media M with different sizes, and even a recording medium M with any size is transported in a state in which one end thereof in the width direction is located at a predetermined position.

Figure 3A:
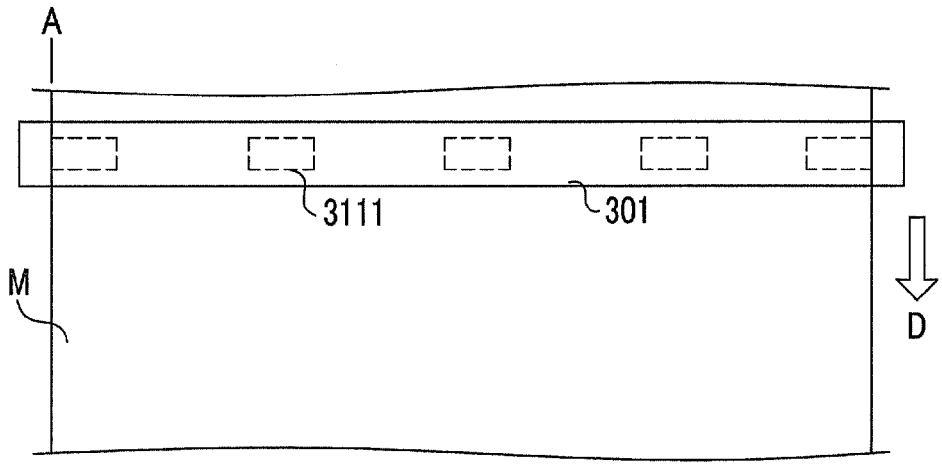
FIGS. 3A and 3B are diagrams illustrating a state in which recording media with different widths are transported.
Figure 3B:
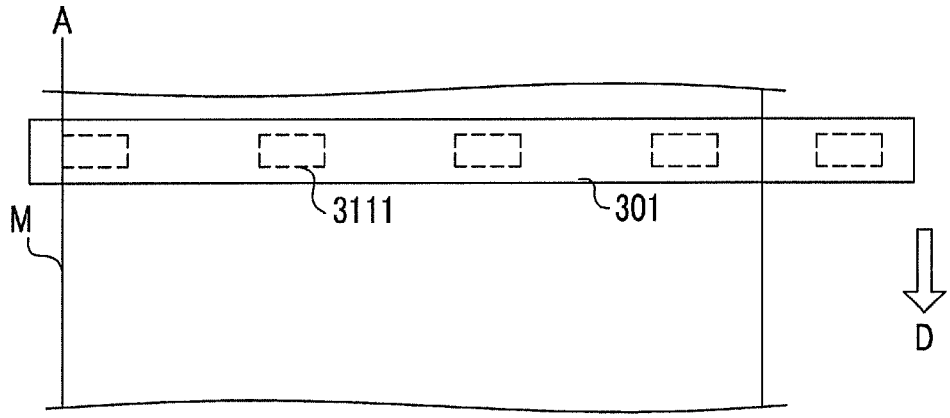

FIGS. 3A and 3B are diagrams illustrating a state in which recording media M with different widths are transported. FIGS. 3A and 3B show a positional relationship between the transported recording medium M and the irradiation unit 311 (the supporting member 301). FIGS. 3A and 3B show an example in which the supporting member 301 is located at a predetermined reference position. In this example, a position where a direction in which the light emitting elements 3111 are disposed is perpendicular to the transport direction of the recording medium M is the reference position. In addition, in this example, this state is defined as rotation angle zero. FIG. 3A shows an example in which the recording medium M with a larger width than in FIG. 3B is transported. In either case, the recording medium M is transported in a state in which one end thereof is located at a predetermined position (the line A in the figures; hereinafter, this position is referred to as a reference position of transport of recording medium).

FIGS. 2A and 2B are referred to again. The control circuit 331 determines (controls) an amount of power supplied to the irradiation unit 311 according to a size of the recording medium M. The control circuit 331 controls the driving circuit 341 so as to supply the determined amount of power. Further, in this example, the control circuit 331 also controls the driving circuit 322.

A set of the irradiation unit 311 and the optical member 312 is an example of the fixing unit 31. The n light emitting elements 3111 are an example of plural fixing elements. The motor 321 and the driving circuit 322 are an example of the varying unit 32. The control circuit 331 is an example of the controller 33. The driving circuit 341 is an example of the supply unit 34.

Figure 4:
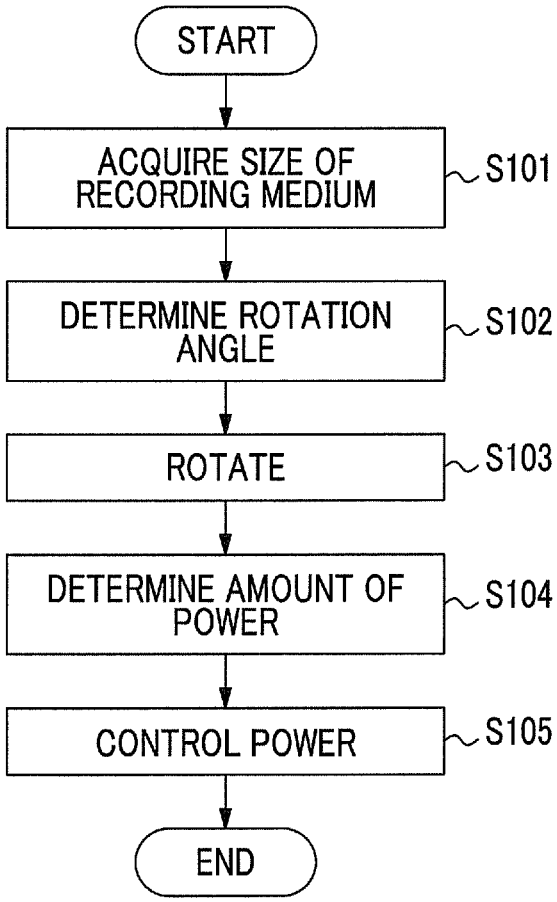
FIG. 4 is a flowchart illustrating an operation of the fixing device.

FIG. 4 is a flowchart illustrating an operation of the fixing device 30. The flow of FIG. 4 starts using a predetermined event, for example, changing in a recording medium which is used or powered-on of the image forming apparatus 1, as a trigger. In step S101, the control circuit 331 acquires information indicating a size of the recording medium M. The size of the recording medium M described here is a length in a direction perpendicular to the transport direction, that is, a width of the recording medium M. The size of the recording medium M is detected using a well-known technique.

In step S102, the control circuit 331 determines a rotation angle θ of the supporting member 301 according to the size of the recording medium M. The control circuit 331 determines a rotation angle by referring to information (for example, a table in which corresponding rotation angles are recorded with respect to respective plural sizes which are expected, or a function which outputs a rotation angle when a size is input thereto) which correlates a size of the recording medium M and with a rotation angle. This information is stored in an internal memory of the control circuit 331 or an external storage device.

In step S103, the control circuit 331 controls the driving circuit 322 so as to rotate the supporting member 301 according to the determined rotation angle θ. The driving circuit 322 drives the motor 321 under the control of the control circuit 331. The motor 321 rotates the supporting member 301 at the rotation angle θ.

Figure 5:
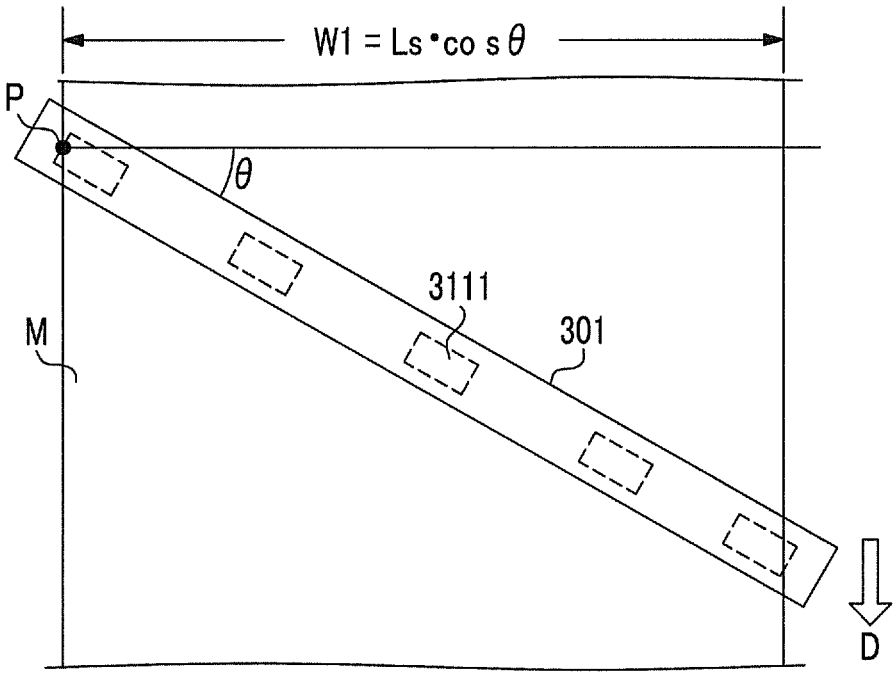
FIG. 5 is a diagram exemplifying a positional relationship between an irradiation unit after being rotated and a recording medium.

FIG. 5 is a diagram exemplifying a positional relationship between the irradiation unit 311 after being rotated and the recording medium M. In this example, the irradiation unit 311 is rotated such that the length (orthogonal projection onto an axis perpendicular to the transport direction) Ls which is perpendicular to the transport direction varies according to the width of the recording medium M. Details are as follows. Now, if the maximum width of the available recording medium M in the image forming apparatus 1 is Wmax, the rotation angle θ of the irradiation unit 311 is zero at this time, and Ls=Wmax (1).

When a recording medium with a width Wk (Wk<Wmax) is used, Ls·cos θk=Wk (2) after the irradiation unit 311 is rotated at a rotation angle θk.

In other words, from Equations (1) and (2), cos θk=Wk/Wmax (3). As described above, the control circuit 331 determines the rotation angle θk with respect to the size Wk of the given recording medium M by referring to the information which correlates the size Wk of the recording medium M and the rotation angle θk. In addition, in this example, a rotation axis R of the irradiation unit 311 is located on the reference position A.

FIG. 4 is referred to again. In step S104, the control circuit 331 determines an amount of power (that is, an amount of power provided to the light emitting elements 3111) supplied to the irradiation unit 311. The control circuit 331 determines an amount of power according to the rotation angle determined in step S103. Specifically, the control circuit 331 determines an amount of power P supplied to the irradiation unit 311 according to the following Equation (4). P=Pmax·cos θk (4) where Pmax indicates an amount of power supplied to the irradiation unit 311 at θk=0, that is, an amount of power supplied to the irradiation unit 311 when the width of the recording medium M is Wmax.

In step S105, the control circuit 331 controls the driving circuit 341 such that the determined amount of power is supplied to the irradiation unit 311. The driving circuit 341 supplies power to the irradiation unit 311 in response to a signal supplied from the control circuit 331. The driving circuit 341 supplies power for operating all the plural light emitting elements 3111 to the irradiation unit 311 during fixing. According to the fixing device 30, power consumption is reduced as compared with a case where power is not controlled according to a rotation angle.

The present invention is not limited to the above-described exemplary embodiment and may have various modifications. Hereinafter, some of modified examples will be described. The following modified examples may be used through a combination of two or more modified examples.

A method in which the varying unit 32 varies a length of the fixing unit 31 in a direction perpendicular to the transport direction D is not limited to rotating the fixing unit 31. The varying unit 32 may vary a length of the fixing unit 31 in a direction perpendicular to the transport direction D using methods other than the rotation, for example, by the varying unit 32 varying an interval between plural fixing elements (that is, an interval between two adjacent fixing elements).

Figure 6A:
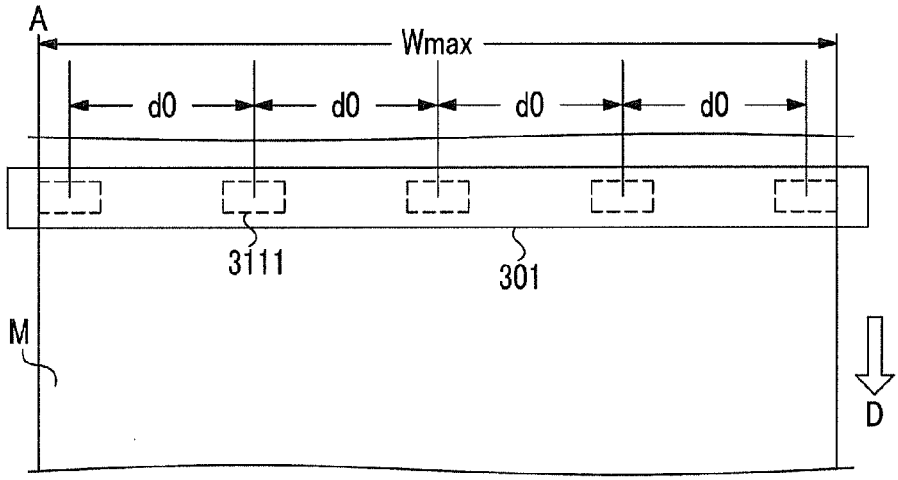
FIGS. 6A and 6B are diagrams illustrating an example of variations in intervals between fixing units.
Figure 6B:
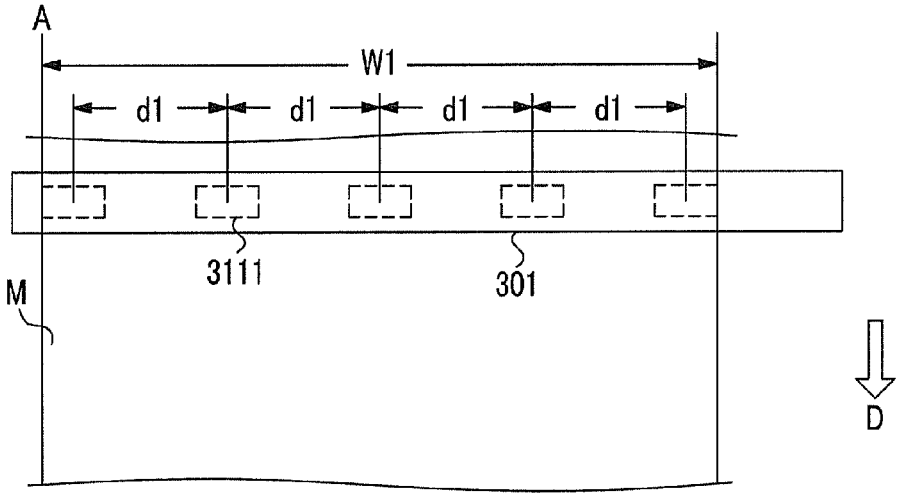

FIGS. 6A and 6B are diagrams illustrating an example of varying an interval between the fixing units 31. In this example, an interval of d0 between the fixing units 31 when the width of the recording medium M is Wmax is varied to an interval of d1 between the fixing units 31 when the width of the recording medium M is W1 (<Wmax). In addition, as a specific configuration for varying an interval between the fixing units 31, for example, a motor, a gear, and a rack are used. In this case, in relation to power supplied to the plural fixing elements, an amount of power can be uniformly reduced with respect to all the fixing units 31. In another example, a larger amount of power may be supplied to the fixing elements located at both ends than the other fixing elements among the plural fixing elements.

In a case of rotating the fixing unit 31, a rotation axis thereof may not be located on the reference position A or in the vicinity thereof. For example, a rotation axis may be located around a center (centroid) of the fixing unit 31. The fixing unit 31 is not limited to performing fixing with light energy (in the exemplary embodiment, the laser array). The fixing unit 31 may perform fixing with heat energy. In addition, the fixing unit 31 is not limited to having plural fixing elements. The fixing unit 31 may have a single fixing element.

The recording medium M is not limited to continuous paper. Cut paper sheets into which paper (of one page) is cut with a predetermined size may be used as the recording medium M.

A specific structure of the fixing device 30 is not limited to the structure described above. The constituent elements described in FIGS. 2A and 2B are only an example, and some of the constituent elements may be omitted or a new constituent element may be added.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing unit that is disposed in a direction intersecting a transport direction in which a recording medium on which an image is formed using an image forming material is transported and that fixes the image forming material onto the recording medium in a noncontact manner with the recording medium;

a varying unit that varies a length of the fixing unit in a direction perpendicular to the transport direction; and a controller that controls the fixing unit at an amount of power according to the length of the fixing unit, wherein the fixing unit includes a plurality of fixing elements, and the controller is configured to be able to supply different amounts of power to each of the plurality of fixing elements.

2. The fixing device according to claim 1, wherein the controller causes all of the fixing elements to be turned on during fixing.

3. The fixing device according to claim 1, wherein the varying unit rotates the fixing unit with respect to a rotation axis intersecting a transport surface of the recording medium, and wherein the controller controls the amount of power according to a rotation angle of the fixing unit.

4. The fixing device according to claim 2, wherein the varying unit rotates the fixing unit with respect to a rotation axis intersecting a transport surface of the recording medium, and wherein the controller controls the amount of power according to a rotation angle of the fixing unit.

5. The fixing device according to claim 1, wherein the varying unit moves the plurality of fixing elements such that an interval between the plurality of fixing elements is varied, and wherein the controller controls the amount of power according to an interval between the fixing elements.

6. The fixing device according to claim 2, wherein the varying unit moves the plurality of fixing elements such that an interval between the plurality of fixing elements is varied, and wherein the controller controls the amount of power according to an interval between the fixing elements.

7. An image forming apparatus comprising:

an image forming unit that forms an image on a recording medium using an image forming material;

a fixing unit that is disposed in a direction intersecting a transport direction in which the recording medium on which the image is formed using the image forming material is transported and that fixes the image forming material onto the recording medium in a noncontact manner with the recording medium;

a varying unit that varies a length of the fixing unit in a direction perpendicular to the transport direction; and a controller that controls the fixing unit at an amount of power according to the length of the fixing unit, wherein the fixing unit includes a plurality of fixing elements, and the controller is configured to be able to supply different amounts of power to each of the plurality of fixing elements.

* * * * *